United States Patent [19]

Shelmire

[11] 3,980,293

[45] Sept. 14, 1976

[54] SHEET FEEDING WITH REAR SHEET SEPARATION

[75] Inventor: Donald W. Shelmire, Churchville, Pa.

[73] Assignee: FMC Corporation, San Jose, Calif.

[22] Filed: Oct. 10, 1974

[21] Appl. No.: 513,608

[52] U.S. Cl. ..... 271/93; 271/11; 271/30 R; 271/98; 271/104; 271/106; 271/108

[51] Int. Cl.[2] ..... B65H 3/08; B65H 3/48

[58] Field of Search ..... 271/93, 91, 98, 97, 271/106, 108, 30 R, 31, 11, 12, 13, 92, 103, 104, 105, 20, 107

[56] References Cited

UNITED STATES PATENTS

| | | | |
|---|---|---|---|
| 1,684,741 | 9/1928 | Nitsch et al. | 271/95 |
| 2,406,765 | 9/1946 | Harrold | 271/98 |
| 2,941,799 | 6/1960 | Reincke | 271/92 |

FOREIGN PATENTS OR APPLICATIONS

| | | | |
|---|---|---|---|
| 949,325 | 2/1964 | United Kingdom | 271/98 |

*Primary Examiner*—John J. Love
*Assistant Examiner*—Bruce H. Stoner, Jr.
*Attorney, Agent, or Firm*—C. E. Tripp; R. B. Catto

[57] ABSTRACT

A sheet feeding device includes an elevator table for supporting a stack of sheets and a front sheet vacuum head for lifting and presenting the front edge portion of the top sheet to feed rolls. A rear sheet separator includes a pivoted vacuum shoe having a curved, vacuumized face for lifting the rear edge portion of the top sheet prior to directing a rear air jet forwardly between the top upper sheet and the underlying sheet, and prior to feeding of the sheet. A rearwardly directed air jet at the front of the stack cooperates with the rear jet to provide an air cushion beneath the top sheet. The rear sheet separator shoe is mounted on upper and lower links which are actuated by an air cylinder to roll the vacuum shoe along the sheet as the shoe lifts the top sheet. Thus, the vacuum applied to the vacuum shoe is not relied upon to physically move the shoe, and the vacuum can be low enough so that a porous top sheet will substantially block off the vacuum ports in the shoe and the second sheet will not be lifted by the shoe. Hold down feet mounted on bell cranks that actuate the shoe through links hold down the rear edge of the second sheet while the rear edge of the top sheet is being lifted to receive air from the rear air jet. The hold down feet are raised from the stack before the feed rolls feed the top sheet.

12 Claims, 16 Drawing Figures

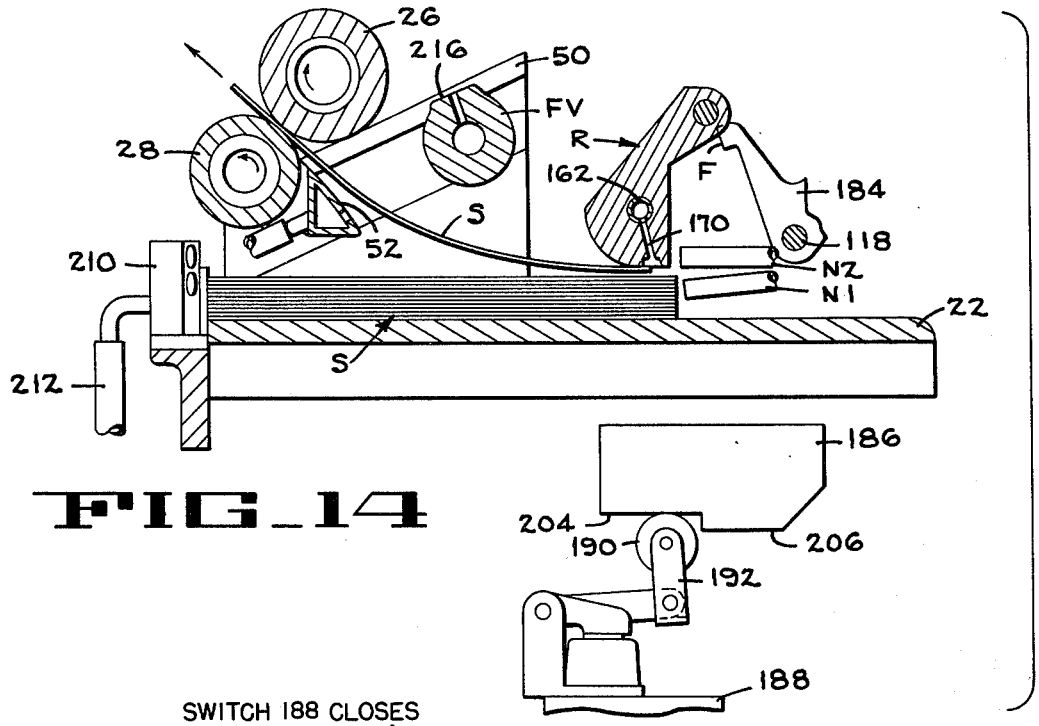
FIG_14
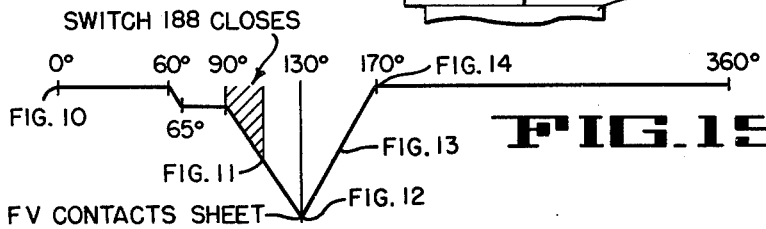
FIG_15
FIG_16
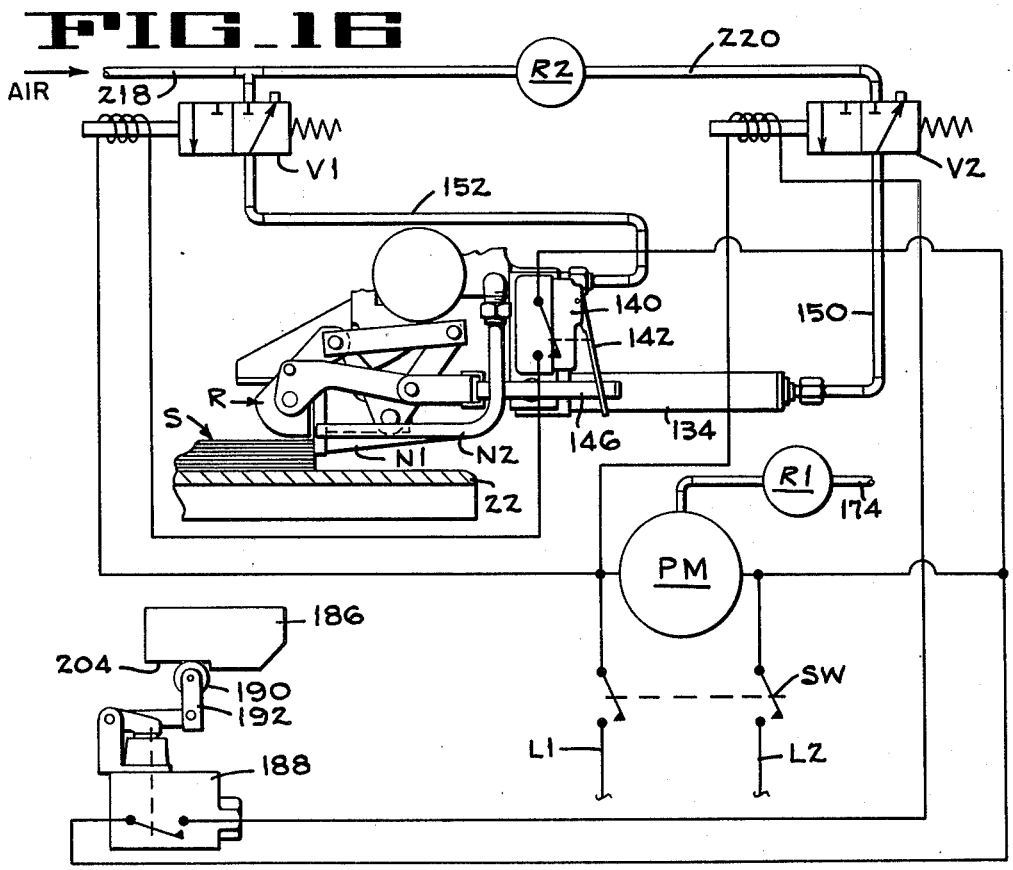

SHEET FEEDING WITH REAR SHEET SEPARATION

BACKGROUND OF THE INVENTION

1. Field of the Invention

The present invention relates to sheet feeding apparatus and more specifically to sheet feeding apparatus for insuring that only the top sheet of a stack of sheets, such as labels and box wrapper sheets will be fed from the apparatus to a gluing machine, or to any other processing machine, without disturbing the underlying sheets of the stack.

2. Description of the Prior Art

It has been found that vacuum pickup heads at the front of the stack may cause the feeding of more than the top sheet in a stack. For example, paper sheets are commonly formed by shearing or cutting a stack of sheets at once. If the knives are dull, this causes the paper fibers along the sheared sides of the stack to interlock to some degree so that if attempts are made to merely slide the top sheet across the second sheet, the second sheet may be pulled along with the top sheet. A similar problem arises when the sheets are embossed; such sheets resist pure sliding separation.

A prior art sheet feeding device of the type to which one embodiment of the present invention relates is disclosed in the Nitsch et al U.S. Pat. No. 1,684,741, issued on Sept. 18, 1928. The U.S. Pat. No. 2,726,861, to Wolff et al issued Dec. 15, 1955, discloses a vacuumized rear sheet separator over which the rear sheet separator of the present invention is an improvement.

The feeders of these patents are associated with gluing machines, wherein the top sheet of a stack of sheets is fed into glue rollers. Both patented structures employ elevating tables which support the stack of sheets, and which are incrementally elevated to maintain the uppermost sheet near a given pickup position.

In the sheet feeding mechanism of the Nitsch et al U.S. Pat. No. 1,684,741, an articulated front vacuum pickup head overlies the front edge portion of the stack. The rear edge of the stack is engaged by a slidably mounted foot which holds the sheets down by force of gravity which mounts a back stop. When a sheet is to be removed from the stack, vacuum is applied to the front pick up head, and the head with a sheet gripped thereby is lifted to bring the front edge of the sheet against an upper, driven feed roll. A lower feed roll is then brought against the sheet and the feed rolls slide the sheet across the stack for transport past glue rolls and onto a delivery conveyor. In this patented device, although the front end of the sheet is lifted by the front vacuum feed head, the feed head itself does not slide the top sheet along the second sheet while the top sheet is being lifted, all such sliding action results solely from the grip of the feed rolls on the sheet after the front edge of the sheet has been lifted by the front vacuum head.

In the Wolff et al U.S. Pat. No. 2,726,861 the simple hold down device of the Nitsch et al patent is replaced by a combined vacuumized rear sheet separator and a mechanically actuated hold down foot. Here the rear of the top sheet in the stack is lifted by a pivoted, flat faced vacuum head, whereupon a mechanically actuated finger or hold down foot holds down the second sheet. A vacuum feeding head at the front of the stack grips the front edge of the top sheet, and not only lifts the sheet, but slides it across the stack and between the feed rolls. While the front vacuum head is thus feeding the sheet, the vacuum to the rear sheet separator is cut off. However, the rear hold down foot engages the stack and thus prevents the front vacuum head from pulling the second sheet along with the top sheet. A rearwardly directed air jet is provided at the front of the stack.

Referring to the construction and mode of operation of the rear sheet separator itself, of the Wolff et at patent, the rear vacuum or suction head is pivotally mounted in the chamber of a floating block. The vacuum line connects to the chamber in the block, and not directly to the rear suction head. The suction head is spring biased downwardly to contact a sheet. Apertures extending through the suction head communicate with the chamber, and it is intended that these apertures be closed off when the suction head is in contact with the top sheet. When vacuum is applied to the chamber, the differential or net atmosphere pressure acting on the underside of the top sheet and hence on the suction head, must lift the weight of the head against the bias of the spring, and must overcome friction forces developed by any sealing contact that exists between the suction head and the walls of the vacuum chamber in which the suction head is mounted. Of course, this means that leakage of air around the suction head reduces the effective or differential pressure available to lift the suction head and the associated sheet. Furthermore, if the sheets are somewhat porous or pervious to air, and if the degree of vacuum applied to the chamber is adequate to lift the suction head against its own weight, against friction and against the force of the spring, such a vacuum can induce air flow through the uppermost sheet in the stack and into the vacuum ports in the suction head. Air flow through the top sheet can create a sub-atmosphere pressure zone between the top sheet and the second sheet below it, (Bernoulli effect), and may cause the rear edge of the second sheet to be picked up with the top sheet. Another characteristic of the device of Wolff et al is that the pivoted suction head and the walls of the chamber in the block within which it operates are subject to wear and require careful machining to minimize leakage.

A back stop is required in devices of this type. In the device of Nitsch el at, the back stop is mounted on the hold down foot and will be lifted by the feed table before a full stack has been removed. The back stop of Wolff et al, is mounted on a vertically stationary block that floatingly supports the rear sheet separator assembly, so that the back stop limits the lift of the feed table.

SUMMARY OF THE INVENTION

One aspect of the present invention relates to the problem of feeding a single sheet from the stack in a machine having a sheet feeding apparatus of the type shown in the aforesaid Nitsch et al patent.

In a sheet feeding apparatus of the Nitsch et al type, the front edge of the sheet is merely lifted by the front vacuum head for presentation to the upper feed roll, and the front vacuum head is not translated to slide the top sheet across the second sheet. Thus the actual feeding or sliding of sheets from the stack is performed by the feed rolls. Under these circumstances the provision of a mechanically actuated hold down foot at the rear of the stack, for restraining the second sheet is futile, in cases where the front vacuum head presents more than one sheet to the feed rolls. If the rolls receive two sheets, the second sheet would either be stripped from beneath the hold down foot, the second sheet would be torn, or both. This represents a difference between all feed roll feeding systems like that of Nitsch et al and that of the Wolff et al patent, wherein part of the feeding is performed by the front vacuum head.

Even if the front vacuum feeder of the Wolff et al patent picks up two sheets, it will not exert a powerful enough grip on the second sheet to pull the second sheet out from under the rear hold down foot, and thus the foot can be relied upon to clamp the sheets during feeding.

Accordingly, in an embodiment of the present invention which employs a feeding system like that of the Nitsch et al patent, the rear hold down foot is disengaged from the stack during feeding of sheets by the feed rolls. Single sheet feeding is provided, not by mechanically restraining the second sheet, but by establishing an "air cushion" beneath substantially the entire under surface of the top sheet.

The aforesaid "air cushion" is provided as follows:

a. The rear, vacuumized sheet separator shoe curls up the rear edge of the top sheet only, even when the sheets are porous. As will be seen, the manner in which this is accomplished forms another aspect of the invention to be explained presently.

b. The rear sheet separator shoe supports the curled up or lifted rear edge of the top sheet a small distance above the second sheet to provide an air entrance throat between those sheets.

c. The rear hold down foot clamps the second sheet to the stack, not to prevent withdrawal of the second sheet by a feeding device, but only to hold the second sheet down during an air blast.

d. A rear air jet is applied through a forwardly directed air nozzle. This jet not only blows air between the rear edges of the top and second sheet, but since the top sheet is also held up slightly by the rear sheet separator, the air can penetrate beneath the separator and forwardly between the sheets. A second air blast applied at the same time riffles the sheets immediately underlying the second sheet.

e. A front air jet is continuously applied through a rearwardly directed front nozzle, and as the front vacuum head lifts the front edge of the top sheet, the front jet cooperates with the rear jet to provide an "air cushion" beneath the top sheet and thus initially free it from the second sheet.

f. By the time the front vacuum head has lifted the front edge of the top sheet to the upper feed roll, the rear sheet separator shoe will have retracted sufficiently to cause the rear hold down feet (the two are mechanically connected) to raise from the stack. Also the rear air jets are turned off. Although the rear sheet separator and the hold down feet have retracted, they have performed their function of freeing the top sheet, without distorting the second sheet, when the feed rolls feed the top sheet.

As mentioned, another aspect of the present invention relates to the construction and mode of operation of the rear sheet separator itself. Under the present invention, the vacuum provided for the rear sheet separator need only generate a differential pressure across the top sheet that is sufficient to lift the top sheet from the stack. The differential pressure effect of the vacuum applied to the rear sheet separator is not relied upon to mechanically actuate the vacuum shoe of the separator. Briefly, and under the present invention, the vacuumized rear sheet separator shoe is mechanically associated with hold down feet on the support which mounts the shoe above the stack. The shoe has a curved sheet-engaging face that is concentric with a shoe pivot that mounts the shoe on interconnected support links that are constructed to rotate the shoe about its pivot. The vacuum line connects directly to a vacuum port in the shoe, instead of to a chamber in which the shoe is mounted. The vacuum shoe support links are separately actuated, as by an air cylinder, to cause rotation of the shoe about its pivot and simultaneous translation of the shoe. The shoe, in effect, rolls along the top sheet, as it picks up its rear edge, and curls the sheet about the curved face of the shoe. This isolation of the vacuum pickup action and the mechanical shoe actuation reduces the degree of vacuum required to that which is adequate to lift the top sheet, and hence the vacuum pickup action does not disturb the second sheet or sheets below it, even when the sheets in the stack are somewhat porous. Of course where the sheets are substantially impervious to air, the degree of vacuum applied to shoe can be as high as is necessary to roll and curl the top sheet.

In accordance with the preferred embodiment of the present invention, levers are pivotally mounted on the support for the rear sheet pickup shoe. Upper and lower links project from the levers, the lower links pivotally support the shoe as described, and the upper links are connected to an offset portion of the shoe for rotating the shoe about its pivot on the lower links. An actuator in the form of a fluid cylinder is connected to the levers for simultaneously translating the shoe and causing it to rotate about its pivot which is concentric with the vacuumized face of the shoe, as described. This causes the aforesaid rolling action of the shoe along the top sheet as the shoe picks up and curls the rear sheet edge from the stack. In this embodiment, the levers that mount the aforesaid links are in the form of bell cranks, the lower legs of which each mount a hold down foot for engaging the second sheet in the stack as the top sheet is picked up by the shoe.

It has been mentioned that a back stop is required for the uppermost sheets at the rear edge of the stack. In accordance with the present invention, the support for the pickup shoe and associated mechanism is arranged so that the support clears the stack elevating table even when the table is at its uppermost position. The back stop for the sheets is slidably mounted on the support so that when the elevating table nears the uppermost limit of its elevation, it engages and elevates the back stop, without lifting the rear hold down feet. This assembly permits removal of all the sheets in the stack from the table while they are guided at their rear edges by the back stop.

BRIEF DESCRIPTION OF THE DRAWINGS

FIGS. 10–14 are successive diagrammatic operational views illustrating the cooperative functions of the gluing machine and the rear sheet separator mechanism.

FIG. 15 is a timing diagram showing the functions which occur in one sheet feeding cycle.

FIG. 16 is a control diagram of the components for coordinating the movements illustrated in FIGS. 10–14.

DESCRIPTION OF THE PREFERRED EMBODIMENTS

Figure 1:
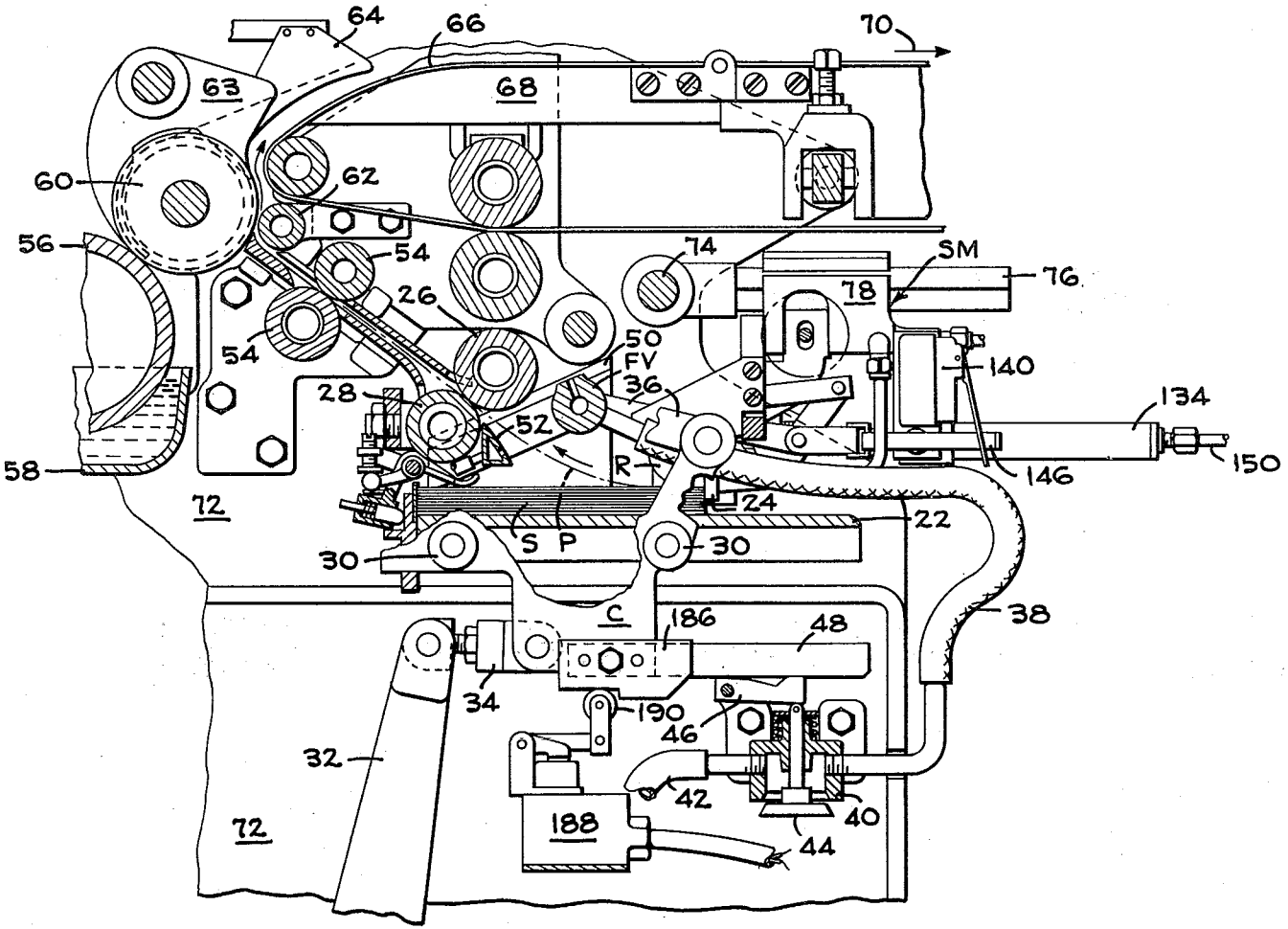
FIG. 1 is a vertical, diagrammatic section of the sheet feeding zone of a known type of gluing machine incorporating the rear sheet separator mechanism of the present invention.

With reference to FIG. 1 and the general organization and operating mode of the present invention, there is shown a known type of gluing machine 20, an early form of which is more fully disclosed in the Nitsch et al U.S. Pat. No. 1,684,741, issued on Sept. 18, 1928, and certain details of which are disclosed in the Andresen Jr. et al U.S. Pat. No. 3,252,701, issued May 24, 1966. The gluing machine 20 is illustrative of one general type of machine with which a rear sheet separator mechanism SM according to the present invention is useful. The sheet handling portion of the gluing machine 20 may be characterized as of the type including an elevator table 22 for supporting a stack of sheets S, a back stop 24 for the stack of sheets, and an articulated front vacuum head FV for lifting the front edge of the top sheet and bringing the sheet toward an upper rotating feel roll 26. Actual sliding of the sheet across the stack (and hence actual feeding) begins when a carriage mounted pinch roll 28 is moved to the feed roll 26 for gripping the sheet.

As for the glue applying sheet conveying portion of the particular machine illustrated, the pinch roll 28 is mounted on a carriage C which is guided by tracks, not shown, engaged with carriage rollers 30. A drive arm 32 swings fore and aft during operation of the gluing machine 20, and is connected to the carriage C by link means 34. The carriage position illustrated in FIG. 1 is the extreme right position, and that in which a previously fed sheet has followed the approximate path P to be gripped and fed by the pinch roll 28 and the feed roll 26 to later described mechanism.

Continuing with general organization and structure of the gluing machine 20, the front vacuum head FV is connected to carriage C by link means 36, and by a hose 38 to a valve 40. A second hose 42 connects the valve to a vacuum pump, not shown, and the valve includes a plunger 44 which will open or close the valve to atmosphere. A valve actuator 46 is arranged to open the plunger 44, when the carriage C carries a camming bar 48 over the actuator 46, and thus vent the front vacuum head FV to atmosphere.

Conversely, when the front vacuum head FV is moved by the carriage C to the left in FIG. 1, the camming bar 48 rides off the valve actuator 46, whereby the plunger 44 closes and vacuum is applied to the vacuum head for lifting the leading edge portion of the next uppermost sheet S. For this purpose, the front vacuum head FV rides down an inclined ramp 50 at each side of the machine. As shown in the Andresen Jr. et al patent supra, the ramps 50 include racks, not shown herein, which are engaged with pinions on the ends of the front vacuum head FV to rotate the head as the head traverses the ramp, and thereby position the vacuum ports toward the sheet when the vacuum head is lowered. During such lowering, the pinch roll 28 and a feed tongue 52, which is also mounted on the carriage C, move away from the stack so that the vacuum head has access thereto. During the operation of the gluing machine 20, a later mentioned and illustrated air blast device blows a continuous jet of air into the front of the stack (the front being where the vacuum head picks up the top sheet) in order to initiate sheet separation and increase the probability that only a single sheet will be lifted by the vacuum head.

From the feed roll 26 and the pinch roll 28 the sheet is fed along the path P between a pair of rolls 54. Adjacent the latter rolls, a glue transfer roll 56 which is wetted in liquid glue contained in a glue tank 58, rolls against a glue distributor roll 60. The sheet runs under a guide roller 62 and against the distributor roll 60 to thereby be coated with glue. Picker blades 63 and stripper plates 64 direct the sheet rearward relative to its former path so that it is delivered glue side up onto the upper reach of a perforated belt 66 that travels over a vacuum box 68, to positively grip the sheet and deliver it in the direction of the arrow 70 to another processing station where the sheet is adhered to a workpiece.

Figure 2:
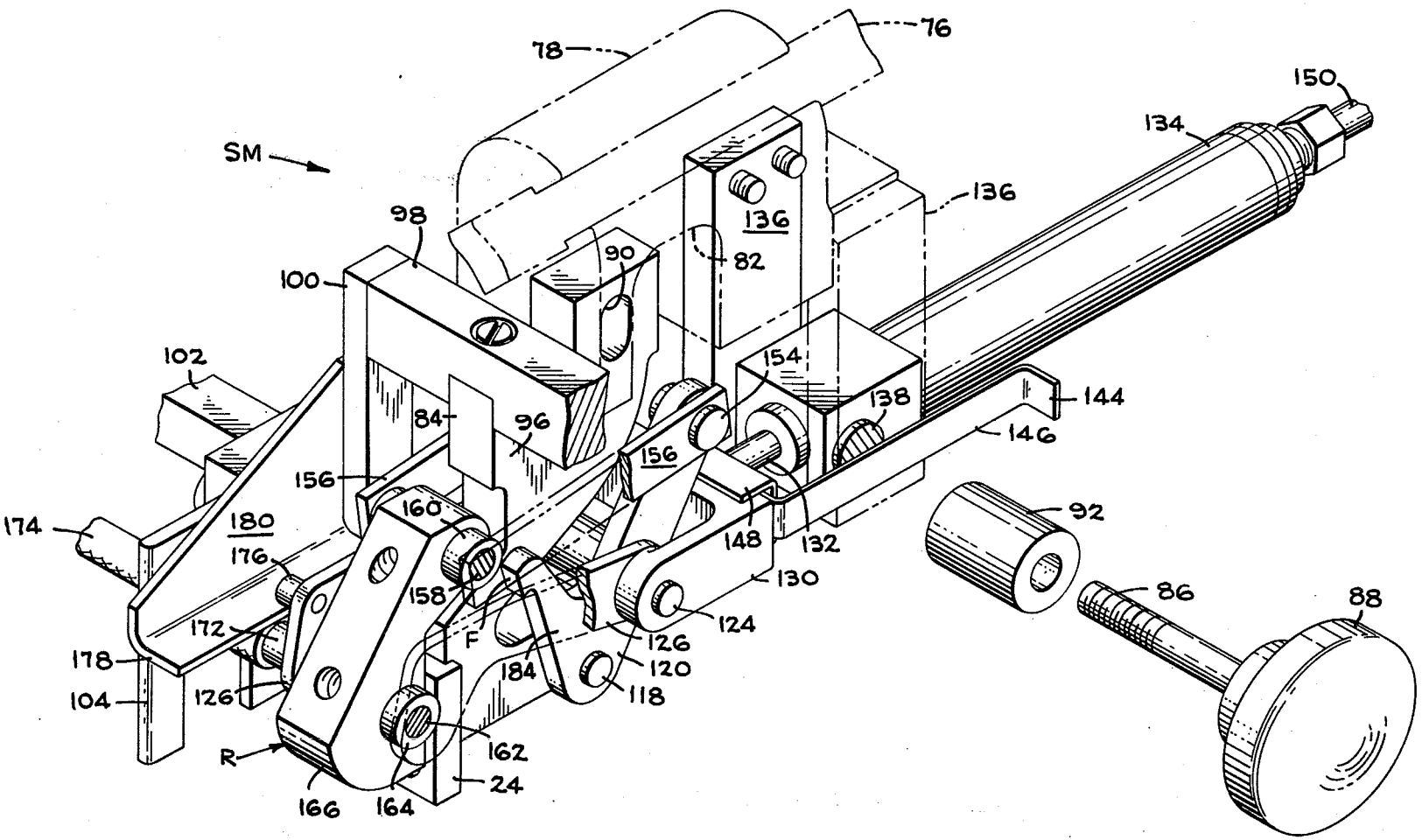
FIG. 2 is an enlarged isometric view of the sheet separator mechanism shown in FIG. 1, partly broken away, and partly in phantom lines to show mechanism which would be otherwise concealed.
Figure 3:
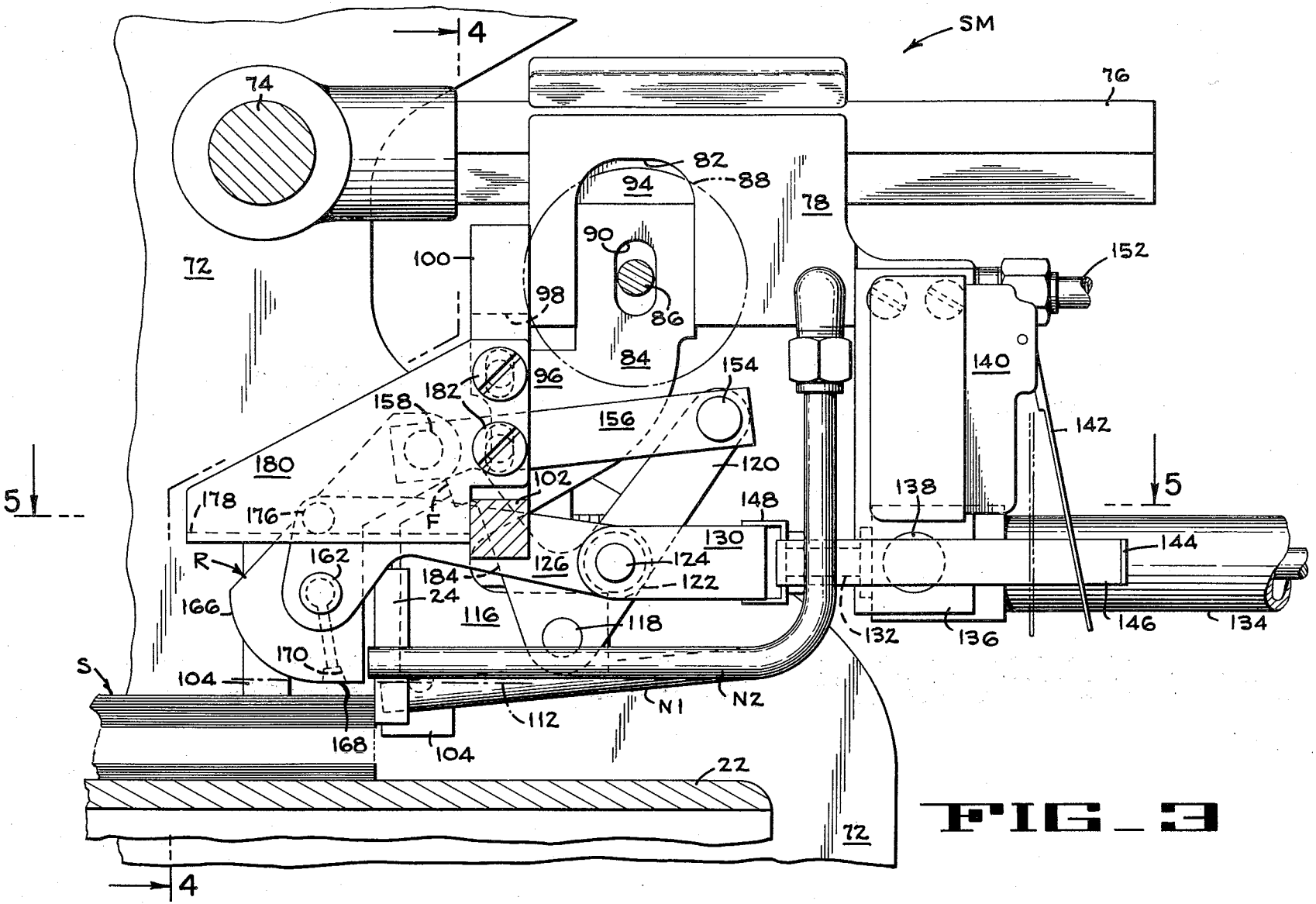
FIG. 3 is a side elevation of the sheet separator mechanism, and also includes part of the gluing machine.

With more specific reference to the structure associated with the present invention, the gluing machine 20 includes spaced sideplates 72, only one being shown, and a fixed transverse tie rod 74. Fixed to, and horizontally projecting from the tie rod is a square support bar 76 (FIGS. 2 and 3). The rear sheet separator mechanism SM of the present invention includes a mechanically actuated, vacuumized rear sheet separator shoe R, hold down feet F, and two forwardly directed air jet nozzles N1 and N2. The mechanism is mounted on a main support block 78 which is slidably adjustable along the support bar 76 and may be locked in an adjusted position by a handwheel 78 (FIG. 4) which is connected to a stud 80 that is threaded through the support block 78 and bears against the bar 76.

A downwardly open recess 82 (FIGS. 2 and 3) which also opens to one side of the support block 78, receives a hook-shaped support plate 84 which depends centrally of the support block 78 and is vertically adjustable relative to the support block. For adjustment purposes, a threaded stud 86 on a handwheel 88 operates in a slot 90 of plate 84. A spacer 92 on the stud 86 is moved by the handwheel 88 to press the support plate 84 against a blind inner surface 94 of the recess 82 and lock the support plate 84 at a selected elevation.

Figure 5:
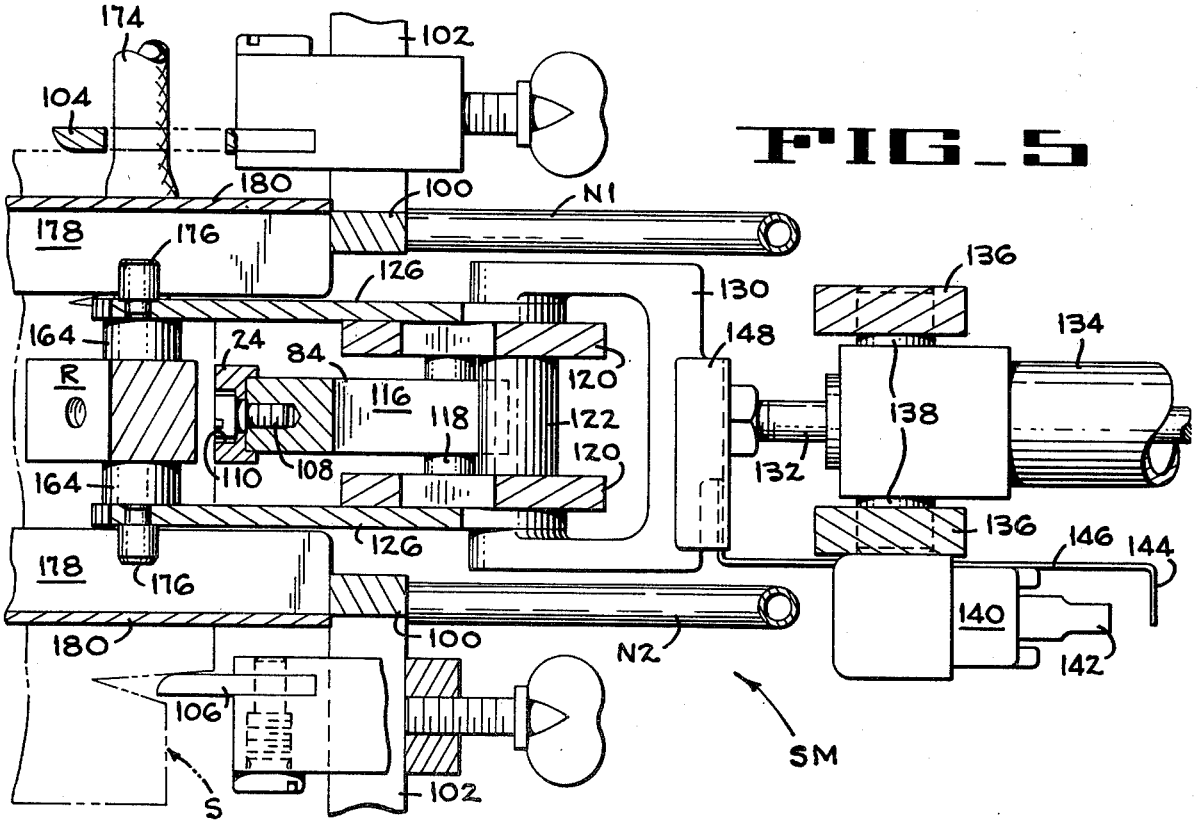
FIG. 5 is a horizontal section taken approximately along lines 5—5 on FIG. 3.

A forward arm 96 of the support plate 84 carries a cross arm 98, from each end of which a rigid depending hanger bar 100 is secured. Each hanger bar, in turn, carries a laterally extending support bar 102. As best shown in FIG. 5, one support bar 102 is provided with an adjustable depending edge guide 104 for one side of the stack of sheets S, and the other support bar 102 is provided with a slidably adjustable corner register guide 106 that is indexed in a notched portion of the particular configuration of sheet S which is illustrated. The edge guide and corner register members 102 and 106 are conventional, and their details and functions are not critical to the present invention.

Figure 4:
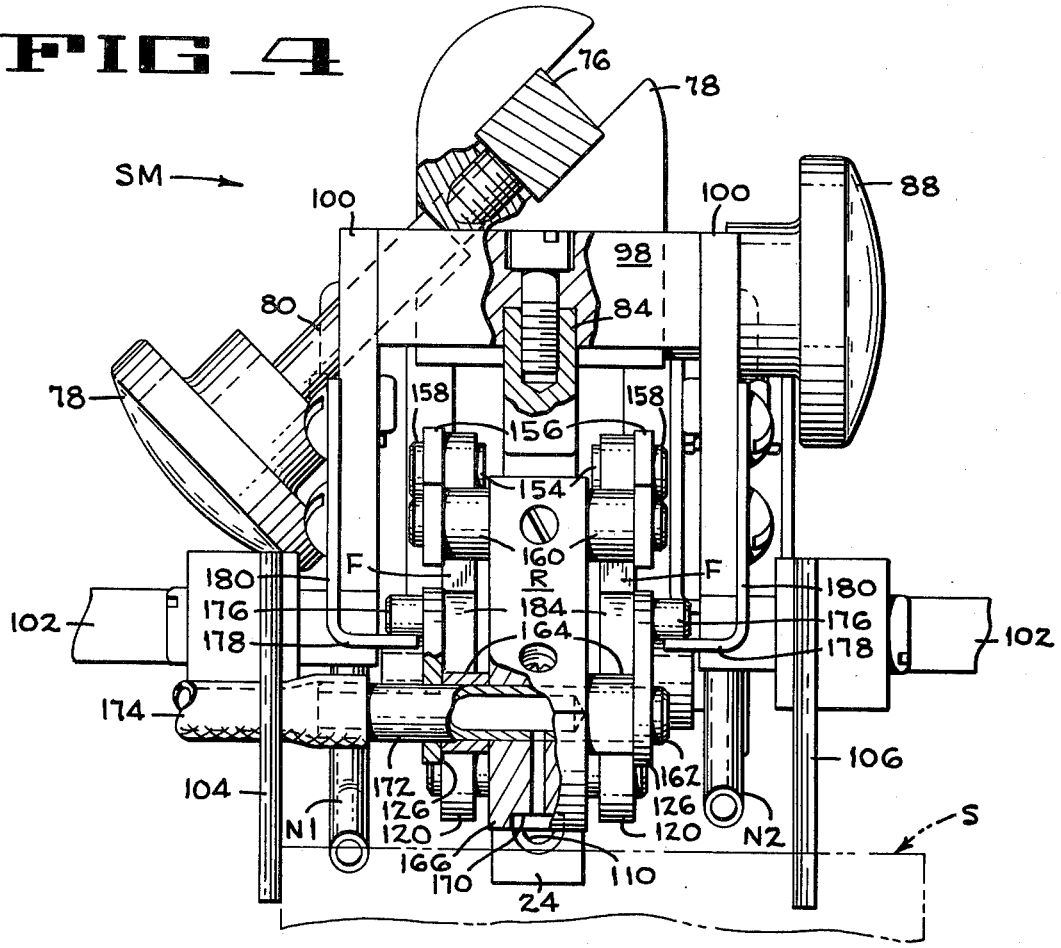
FIG. 4 is an end elevation of the sheet separator mechanism taken in the direction of the arrows 4—4 on FIG. 3.

Intermediate the edge guide and corner register members 102 and 106 (FIG. 5) is an important and, according to one aspect of the present invention, essential structure concerning the back stop 24, namely, means mounting the back stop for vertical displacement. The back stop 24 abuts the rear edge of the stack of sheets S, and is positioned where the elevator table 22 will eventually contact and lift the back stop when an entire stack of sheets is nearly depleted. As later described, this allows uninterrupted feeding of the sheets until the last sheet of the stack is fed to the gluing rollers. Referring to FIGS. 4 and 5, it will be seen that the back stop 24 is loosely held by a bolt 108 operating in an elongate guide slot 110 and threaded into a forward vertical surface of the hook-shaped support plate 84. The back stop 24 is grooved to receive the support plate 84 in order to keep the back stop vertical.

The elevating table 22 (FIG. 3) is capable of being elevated to the approximate reference line 112, which is at or above the feeding position of the top sheet S, but below the lower surface 114 of a rearwardly directed arm 116 of the hook-shaped support plate 84. The arm 116 carries a pivot pin 118 which pivotally supports two spaced bell crank levers 120 (FIG. 4) that are held apart by a spacer 122, above the pivot pin 118. A pivot pin 124 (FIG. 3) extends through the spacer 122 and through two generally L-shaped lower links 126 that straddle the bell crank levers 120, and through a power-actuated clevis 130. The clevis is attached to the piston rod 132 of an air cylinder 134, which mechanically operates the rear sheet separator shoe R and the hold down feet F. Means for mounting the air cylinder 134 to the main support block 78 (FIGS. 3 and 5) include two upright depending arms 136 which are fastened to the block 78. The lower ends of the arms 136 rotatably mount trunnions 138 that are on the adjacent end of the air cylinder 134, and allow the cylinder to pivot slightly about the trunnions 138 in operation, because the clevis pin 124 follows an arcuate path about the pivot pin 118 when the air cylinder drives the clevis.

One of the arms 136 which carry the trunnions 138 has mounted thereto a microswitch 140 which controls the valving of air to the rear air jet nozzles N1, N2. The switch 140 is operated by an actuator 142 which lies in the path of the bent end 144 of a trip arm 146. The trip arm is clamped to the clevis 130 by a bracket 148 to maintain the orientation of the trip arm, and a nut on the end of the piston rod 132 which holds the bracket 148 and the trip arm 146 against the clevis 130. Thus, when air is directed into an air inlet line 150 (FIG. 2) to project the piston rod 132, the clevis 130 is moved away from the air cylinder 134 and the contacts of the microswitch 140 are closed. This energizes a solenoid-operated air valve V1 that is part of a later described control circuit shown in FIG. 15. This directs air under pressure into an inlet conduit 152 (FIG. 3). The conduit 152 communicates with internal passages (not shown) in the main support block 78 to transmit the air into the two air nozzle tubes N1, N2 (see also FIG. 4) having open ends near the top of the stack of sheets S, and straddling the lower links 126. The air blast from the nozzle N2 is directed between the top sheet being removed and the second sheet in order to both break any cohesion between those sheets, and to establish an "air cushion" that inhibits friction as the top sheet is slid across the lower sheet during feeding by the feed rollers. The other nozzle N1 directs its air jet somewhat lower down to assist in riffling the sheets in the stack. In order to select the most efficient location for the open ends of the nozzles N1, N2 they are preferably formed of bendable metal such as copper or aluminum.

At their upper ends, the bell crank levers 120 (FIGS. 3 and 4) are each connected by an individual pivot pin 154 to an upper link 156, as shown for only the near link 156 in FIG. 3. The other ends of the upper links 156, as shown in FIG. 4, are coupled to a pivot pin 158 that extends through spacer tubes 160 and the upper end of the vacuumized rear sheet separator shoe R. In similar manner, the lower links 126 are coupled to the rear vacuum shoe R by a hollow pivot pin 162 and are spaced from the rear vacuum shoe R by spacer tubes 164. As thus far described, it is apparent that the bell crank levers 120 rock forward toward the stack of sheets S about the pivot pin 118 when the air cylinder 134 projects its piston rod 132, and that the support plate 84 is hook-shaped to provide operating clearance for the clevis 130. The upper and lower links 156 and 126, the rear vacuum shoe R, the bell cranks 120 and the pivot pins 124, 154, 158 and 162, in the embodiment of the invention being presently described, form a parallelogram type of linkage wherein imaginary lines interconnecting the pivot axes described a parallelogram.

As shown in FIG. 3, the rear vacuum shoe R is provided with a curved face 166, generated with uniform radius from the axis of the pivot pin 162, that merges with a tangential flat face 168. An internal vacuum port 170 in the vacuum shoe extends between the flat face 168 and the hollow interior of the pivot or trunnion pin 162. One end of the pin 162 (FIG. 4) is closed, and a laterally extended portion 172 on the other end of pin 162 serves as a coupling for a vacuum hose 174 in order to grip the top sheet S to the vacuum shoe when the vacuum pump P (FIG. 15) communicates with the vacuum port 170.

The vacuum shoe R can be floatingly supported by the uppermost sheet S, but in the embodiment shown, the shoe is supported a small distance (about ⅛ inch) above the stack. To thus support the shoe, each link 126 (FIGS. 4 and 5) has a laterally projecting stop pin 176 which will rest upon an inwardly directed flange 178 of a stop plate 180 and thus hold the vacuum shoe R slightly above the top sheet. Each stop plate has vertically elongated slots (FIG. 3) and locking screws 182 that adjustably anchor the stop plates to the associated hanger bar 100. Thus the stop plates 180 can be adjusted to suspend the shoe R above the stack, as described, or they can be lowered to allow the shoe to float on the stack.

Figure 6:
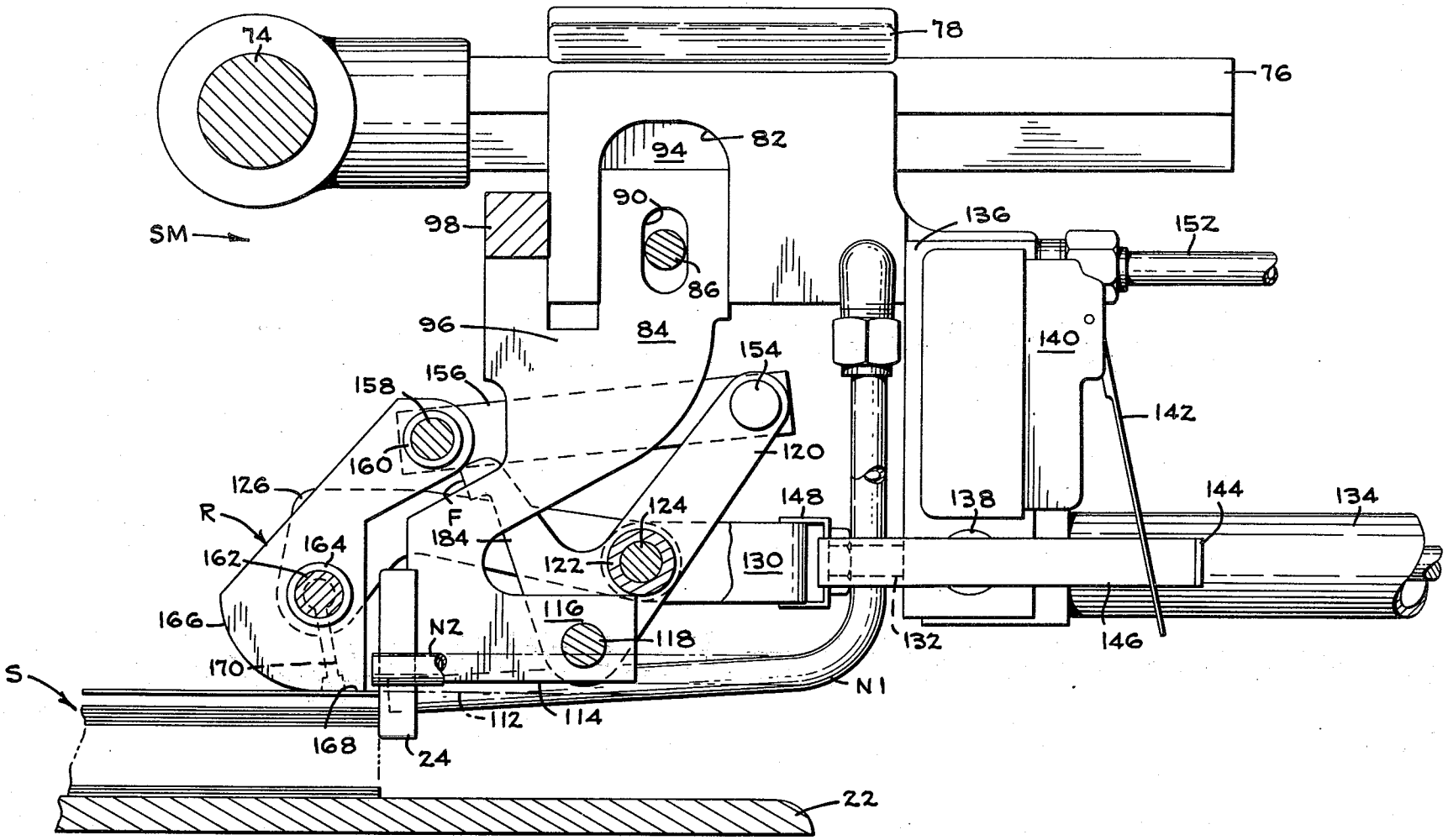
FIGS. 6–8 are schematic sections, similar to FIG. 3, illustrating successive operational positions of the sheet separator mechanism.
Figure 7:
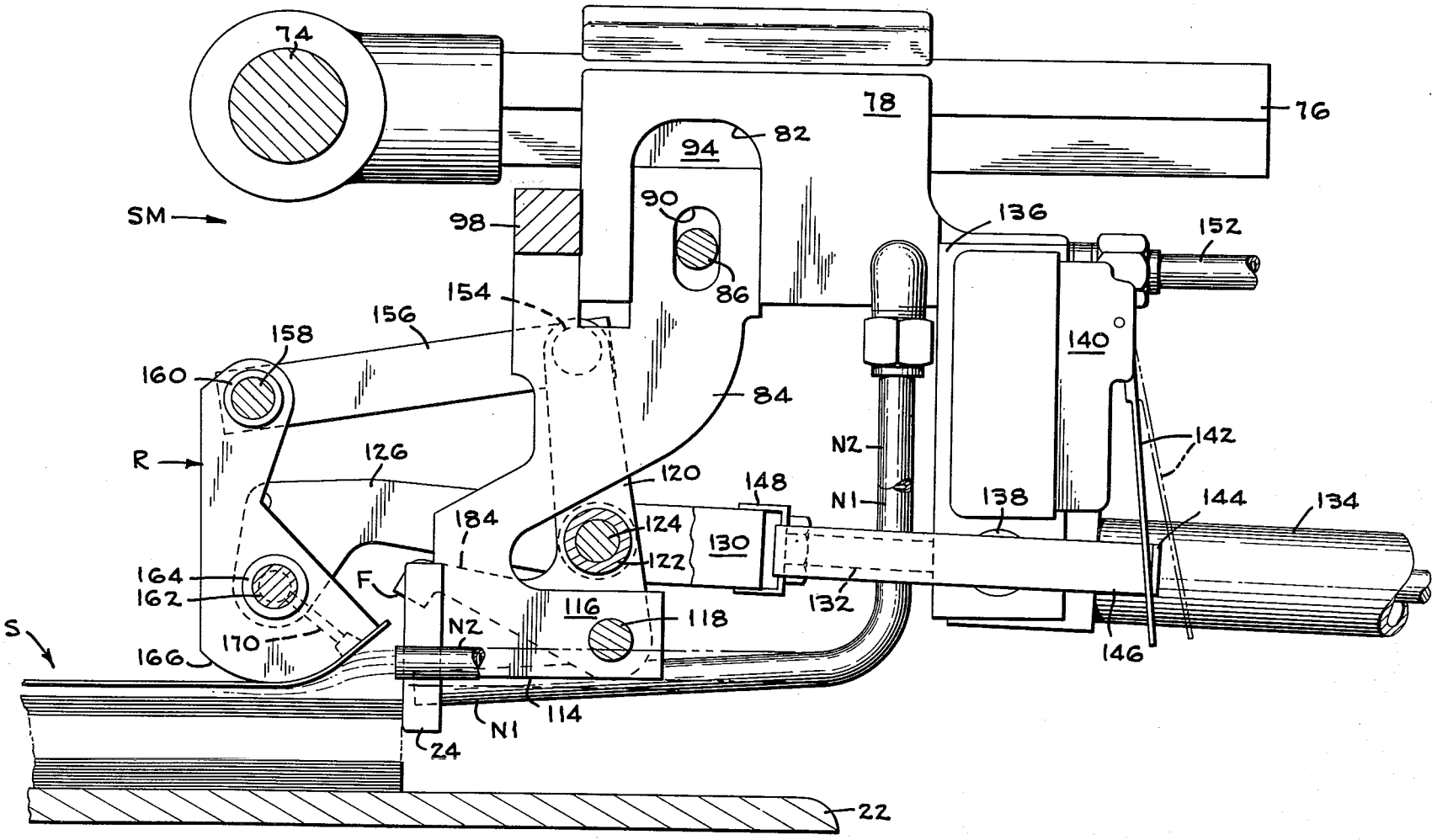
Figure 8:
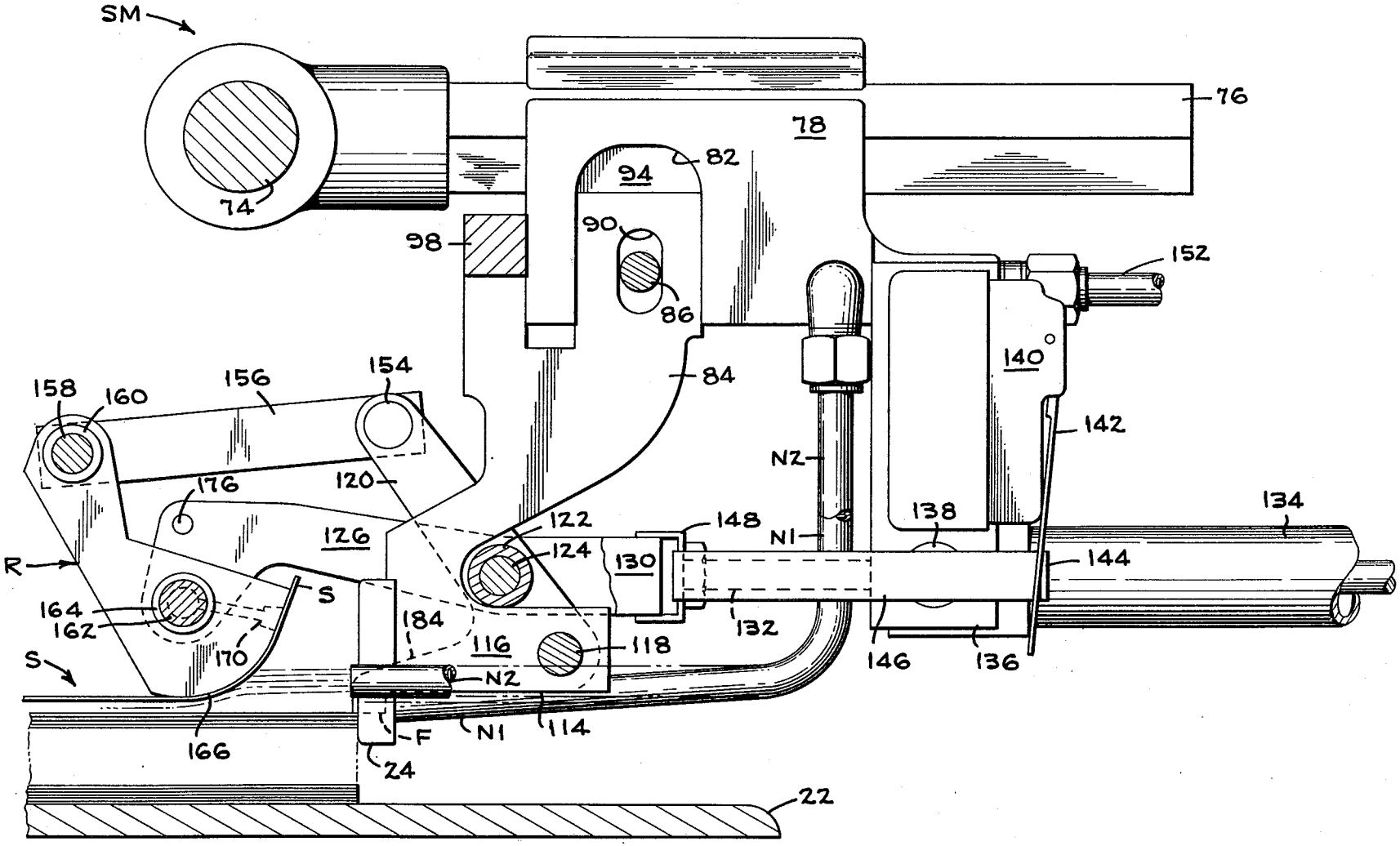

It will be noted that the two bell crank levers 120 (FIGS. 3 and 4) each have a free crank arm 184 which will swing downward about the pivot pin 124 when the air cylinder 134 moves the clevis 130 toward the stack. Each crank arm is provided with a presser foot F movable to engage the rear edge of the stack of sheets S so that the presser feet hold down the second sheet in the stack while the first sheet is being curled upwardly away from that end by the shoe R. Thus, as shown in FIGS. 6–8, an operational sequence may be initiated after a stack of sheets S has been placed on the elevator table 22, and the table has been moved to position the top sheet S at a predetermined level for the sheet feeding operation. The table positioning is done by automatic table elevation means which are conventional in gluing machines, and in other sheet handling devices. One such system is disclosed in the text and FIG. 4 of the aforementioned Nitsch et al U.S. Pat. No. 1,654,741. The sheet separator mechanism SM is adjusted to the particular size of sheets being handled by loosening the main support block 78 (FIG. 4) on the square support bar 76, and sliding the mechanism along the support bar until the back stop 24 (FIG. 3) abuts the stack of sheets. The handwheel 88 (FIG. 4) is then tightened to lock the separator mechanism SM in that position. The sheet guides 104 and 106 (FIG. 5) are also adjusted and locked.

Again referring briefly to FIG. 1, one end of the top sheet is fed by the front vacuum head FV against the upper feed roll 26 while the sheet separator SM acts on the rear portion of the top sheet to free the sheet from the underlying sheet. A carriage mounting the lower feed roll 28 then shifts that roll to pinch the sheet against the upper roll 26 for feeding. Before describing the coaction of the rear sheet separator mechanism SM with the front vacuum head FV, the action of the rear sheet separator itself will be described, in conjunction with FIGS. 6, 7 and 8.

In FIG. 6, the rear vacuum shoe R is fully retracted and the shoe is supported by the pins 176 resting on the shelves 178 (FIG. 4) so that the flat surface 168 of the shoe is about ⅛ inch above the stack. Since the port 170 is vacuumized, this lifts the top sheet against the vacuum shoe. Air under pressure is then directed into the air cylinder 134 so that the piston rod 132 (FIG. 7) thus moves the clevis 130 toward the stack, pivoting the bell cranks 120 about their fixed pivot pins 118.

The parallelogram linkage formed by the bell cranks 120, the upper links 156, the lower links 126 and the shoe R operate to simultaneously translate the shoe pivot trunnions 162 along the stack and to pivot the shoe about the trunnions. The effect of these motions is substantially the same as if the curved face 166 of shoe were simply "rolled" along the stack. In any event, the curved face 166 of the vacuum shoe R begins to curl the top sheet as the clevis 130 is advanced toward the stack. At about this time in the operating cycle, the switch 140 and later described elements cause air under pressure to be admitted to the conduit 152 and directed through the air nozzles tubes N1 and N2. Thus, the air blast at one side of the rear vacuum shoe R is directed from the upper nozzle N2 into the throat defined by the upwardly curling top sheet S and the next underlying sheet. The lower nozzle N1 directs air into the adjacent end of the stack.

The vacuum shoe R is advanced to the FIG. 8 position with the air blasts still active, and the air cylinder trunnions 138 allow pivotal movement of the air cylinder 134 to keep its axis aligned with the pivot pin 124 as the pin swings upward over the bell crank pivot pin 118. Between the positions shown in FIGS. 7 and 8, the presser feet F of the bell crank levers 120 swing downward with close clearance from the adjacent edge of the top sheet S.

With further reference to FIG. 8, the air blast from the upper nozzle N2 tends to rebound downward against the second sheet S from the underside of the curled upper sheet and thus inhibit lifting of the second sheet. Also, the presser or hold down feet F have swung down into contact with the second sheet and positively prevent any upward displacement of the edge of that sheet. It will be evident that the progressive curling of the top sheet as effected by the rear vacuum shoe R provides an initial and continuing force which will effectively break any bond between the first two sheets. Further, and as later described, if the sheets are porous, the degree of vacuum to the rear vacuum shoe R can be throttled to a low value to prevent lifting the second sheet with the first, without in any way affecting the operation of the components powered by the air cylinder 134. In addition, the air blast from the upper nozzle N2 will flow under the top sheet S, and mix with the air blast directed from the other end of the sheet, thus providing an air cushion extending under the entire sheet. Meanwhile, the lower nozzle N1 directs an air blast into the stack of sheets and tends to separate the sheets before they are elevated to the feeding position. It is evident, therefore, that the sheet to sheet bonds in the stack of sheets are either diminished or eliminated, and that the air cushion between the two uppermost sheets subsequently decreases sliding friction therebetween to facilitate lateral movement of the upper sheet across the second sheet during the feeding operation, without disturbing the latter. A further advantage of the present system is that there is less likelihood of permanently marking a stiff sheet with a bend line, because the sheet is progressively curled about the substantially uniform and relatively large radius face 166 of the shoe R.

Figure 9:
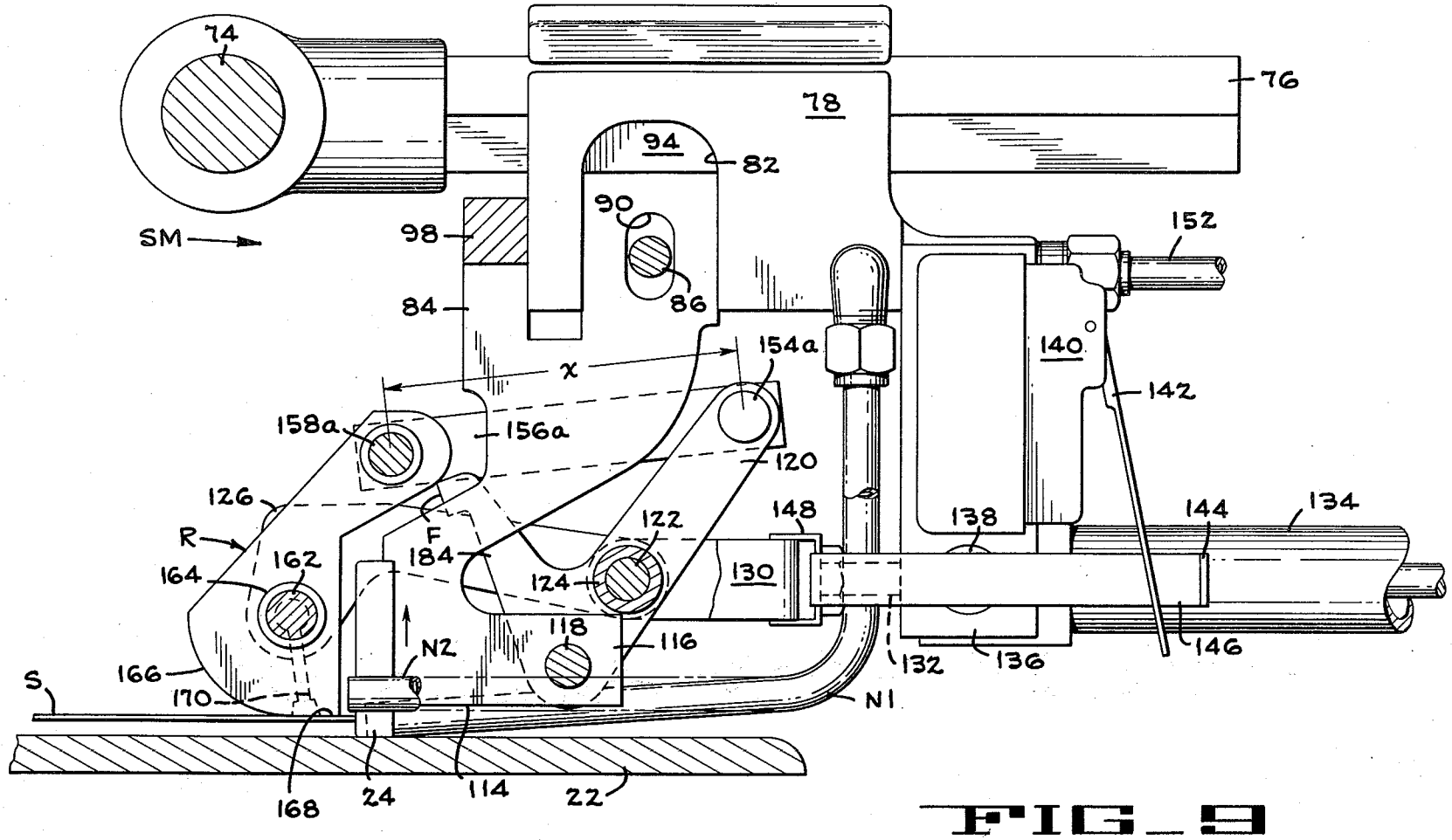
FIG. 9 is a schematic section, similar to FIG. 6, illustrating a second embodiment of the present invention.

FIG. 9 illustrates a second embodiment of the present invention, and also shows the operating advantage which results from the particular back stop 24 which is employed with either embodiment, and shows the cooperative functional relations of the back stop, support plate 84, and the elevating table 22.

As previously mentioned, the lower edge 114 of the support plate 84 lies above the upper surface of the elevating table 22, and the backstop 24 is displaced upwardly by the elevating table when the stack of sheets S is nearly depleted. In this manner, the table 22 ultimately arrives at the FIG. 9 position with only a single sheet S remaining thereon, and the sheet is fed therefrom in the same manner already described. It will be evident that in the present case, the table 22 must be suitably apertured to clear the lower nozzle N1 when the table is elevated to the position illustrated. The sheet feeding operation with the movable back stop 24 prolongs the sheet feeding operation, and the stack requires less attention than in some prior art systems which become inoperative for the delivery function when the sheet stack is about ⅛ of an inch high. An attendant advantage is that there is no guesswork involved, as in some prior art systems, as to when the stack must be replenished. As mentioned, this described feeding of a total stack is common to both the rear sheet separating mechanism previously described, and to the modified sheet separating mechanism in FIG. 9.

In the FIG. 9 modified sheet separating mechanism, the principal difference from the separator previously described is that the distance between axes of the pivot pins 158*a* and 154*a*—indicated by the dimension line *x*—exceeds the distance between the pivot pins 158 and 154 (FIG. 8) by about ⅛ of an inch, and hence the upper links 156*a* are longer than the links 156. Also, the position of the clevis 148 on the piston rod 132 is adjusted to insure that the flat face 168 of the shoe is parallel to the stack when the clevis 148 is retracted. Under these conditions, the angular motion of the rear vacuum shoe R about the pivot pin 162 will exceed the angular motion of the bell crank lever 120 about the pivot pin 118.

With this arrangement, although the vacuum shoe surface 166 basically rolls upon the sheet S as before, the angular rotation of the shoe about its trunnions 162 is greater than in the previous embodiment. Thus, the sheet is also moved rearward edgewise toward the backstop 24 while the vacuum shoe R progressively curls the adjacent edge of the sheet. This extra, edgewise motion of the sheet is useful for sheets which tenaciously cling to each other because the bonds of interlocked fibers, or bonds caused by embossing, are readily disrupted by the thus-produced shearing action.

Reference is again made to FIG. 1 for describing the control elements which actuate the rear sheet separator mechanism SM, and operate in timed relation with the gluing machine 20. The reciprocating carriage C that mounts the lower pinch roll 28, carries a camming plate 186 which actuates a one-direction switch 188. The switch 188 controls the air supply to the air cylinder 134 that moves the linkage for operating the rear sheet vacuum shoe R. The air cylinder 134 is single acting, with an internal spring return (not shown).

The switch 188 (FIG. 10) operates as follows: A roller 190 on the upper end of an upper arm 192 is in rolling contact with lower surfaces of the camming plate 186. Switch arm 192 is pivoted at 194 to a lower arm 196, and the latter arm is pivoted at 198 to a bracket on the switch. The arm 196 is urged by a spring (not shown) to its upper position. Upward movement of the arm 196 about the pivot 198 allows an actuator arm 200 to move upward under the action of a spring (not shown), and thus close internal contacts of the switch.

Figure 10:
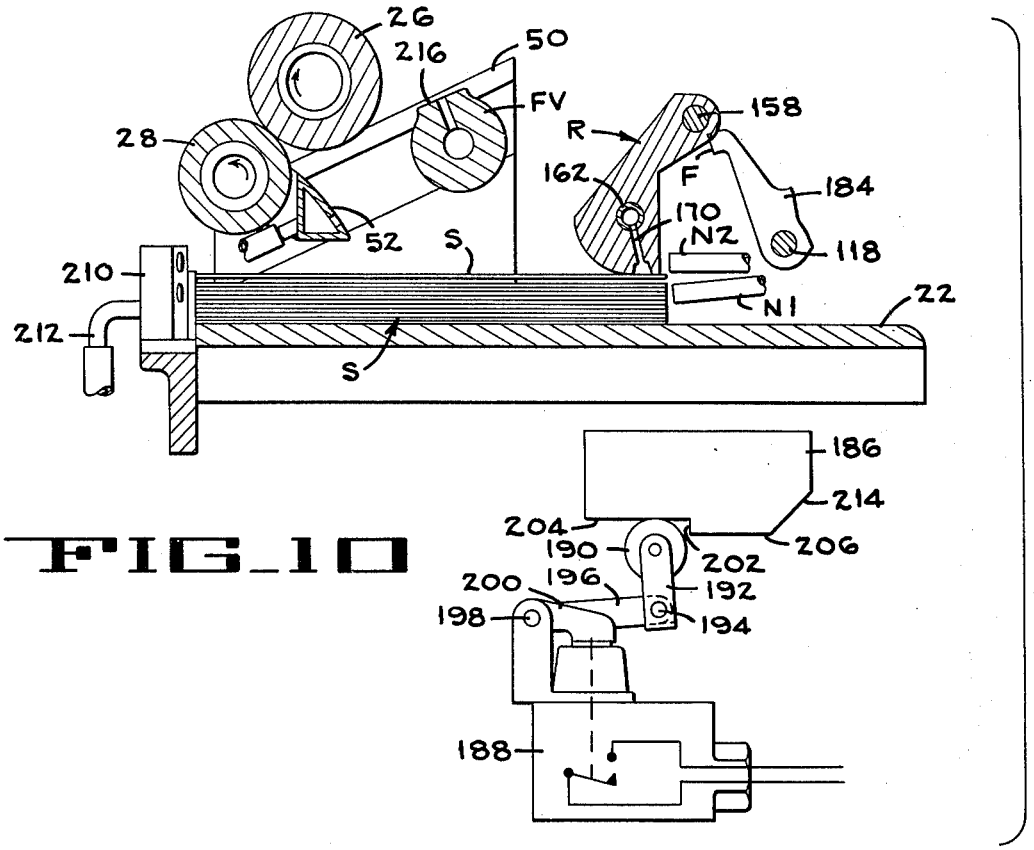
Figure 11:
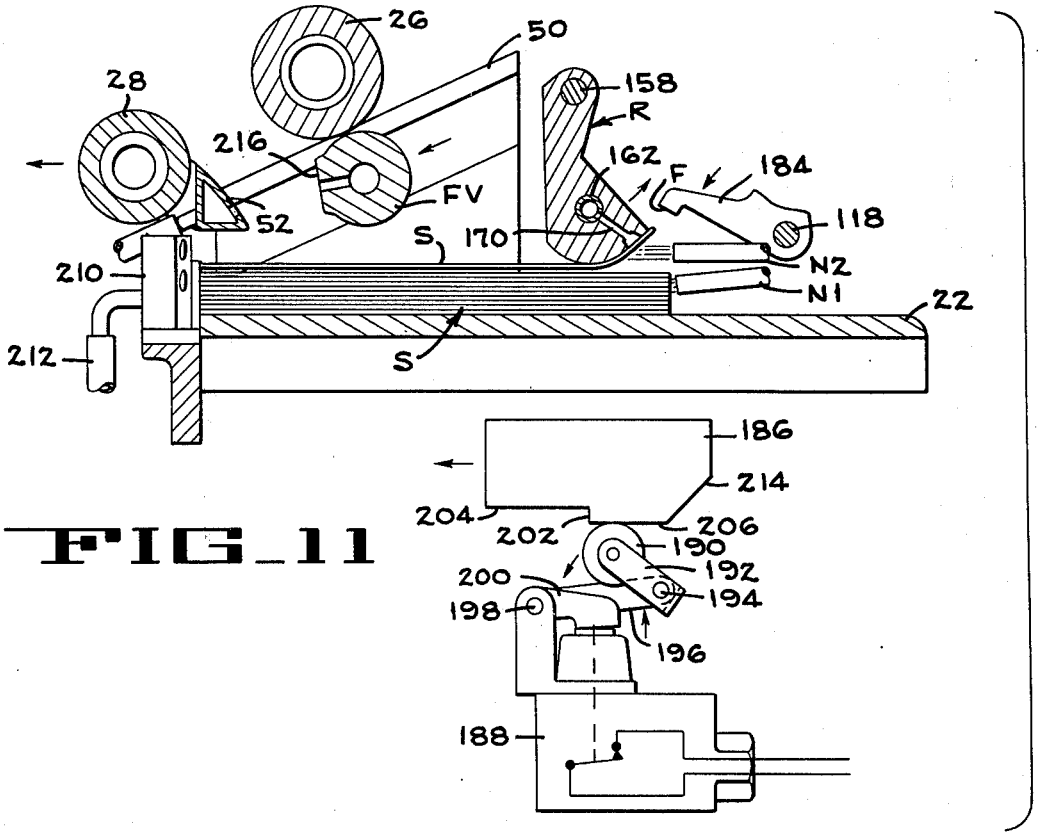

The arm 192 that carries the roller 190 is spring biased to the vertical position of FIG. 10 but can be collapsed, as seen in FIG. 11, which shortens the effective length of the arm 192. The switch illustrated is manufactured by MICRO-SWITCH, a division of Honeywell, Inc., of Freeport, Ill. and is designated as a one-way roller arm switch Model BZE6-2RN28.

In the FIG. 10 position, the roller arm 192 is in its vertical position, the roller 190 is held down by a holding surface 204 on the cam 186, the arms 196 and 200 are held down and the switch contacts 186 (FIG. 16) are open. Thus so long as the holding surface 204 is over the switch roller 190 the cam 186 can move to the left and the contacts of the switch 188 will remain open. The cam 186 is provided with a vertically offset step at 202 between the holding surface 204, and an actuating surface 206. As seen in FIG. 11, the actuating surface 206 collapses the roller arm 192 and allows the arms 196 and 200 to pivot upwardly under force of their springs. This closes the switch contacts.

The cooperative functions of the rear sheet separator mechanism SM with the front vacuum head FV and the feed rollers 26 and 28 will be described in conjunction with FIGS. 10–14. It will be assumed that one sheet feeding cycle extends from 0° to 360° of a shaft (not shown) that shifts the carriage C mounting the pinch roller 28. FIG. 10, with the carriage fully advanced to the right, is designated the 0° position. FIGS. 11–14 show the positions at 110, 130, 150 and 170 degrees. The FIG. 15 timing diagram shows the same single cycle and is labeled to indicate the approximate position of the components shown in FIGS. 10–14.

FIG. 10 diagrammatically illustrates a front air blast distributor 210 which is conventionally used in prior art gluing machines to riffle through the sheets S on the elevator table 22. Air is continuously fed to the distributor 210 through a conduit 212. Similarly, the feed tongue 52 in some prior art gluing machines is provided with air under pressure that exits through ports facing the underside of a sheet fed to the rolls 26 and 28.

In FIG. 10, a previously fed sheet S (not shown) has been removed by the rolls 26 and 28, and the top sheet on the stack is lifted at the rear edge by the continuously evacuated vacuum port 170 in the rear vacuum shoe R. The front vacuum shoe FV is in its highest position. Nozzles N1 and N2 are inactive, and the contacts of the switch 188 are open. The position of the cam 186 is the same as shown in FIG. 1, that is, the carriage C is at its extreme right position.

In FIG. 11, the carriage and its cam 186 have been moved to the left so that the switch actuating surface 206 engages the switch roller 190. When the cam step 202 moved over the roller, the upper switch arm 192 was pivoted about the pivot 194 to collapse toward the lower arm 196. This action allows the contacts of the switch 188 to close within a range of about 90 to 110 degrees in the feeding cycle. Closure of the switch 188 energizes the air cylinder 134 (FIG. 7) to simultaneously translate the rear vacuum shoe R forward and to rock the shoe about the pivot 162. This curls the rear edge of the top sheet gripped by the shoe.

Meanwhile, the front vacuum head FV is descending on the inclined ramp 50, and has rotated its sheet gripping surface 216 toward the sheet. A concurrent action, as shown in FIG. 7, is that the switch 140 on the rear sheet separator has been actuated during forward movement of the vacuum shoe R by the strap 144, 146 so that the air nozzles N1 and N2 direct air blasts toward the sheets. It will be noted that the vacuum shoe R lifts and curls the sheet before the air blasts are turned on. Thus, the air blast from the upper nozzle N2 is directed into the entrance throat defined by the top sheet and the next lower sheet to provide, in cooperation with the front air blast from the air distributor 210, an air cushion tending to float the top sheet. At the same time, the same air blast rebounds downward against the second sheet and holds it down until the presser feet F assume positive hold-down control of that sheet. It will be noted in FIG. 11 that the pinch roller 28 and the feed tongue 52 have been moved away from the stack by the carriage C (FIG. 1) to clear the stack for access by the front vacuum head FV.

Figure 12:
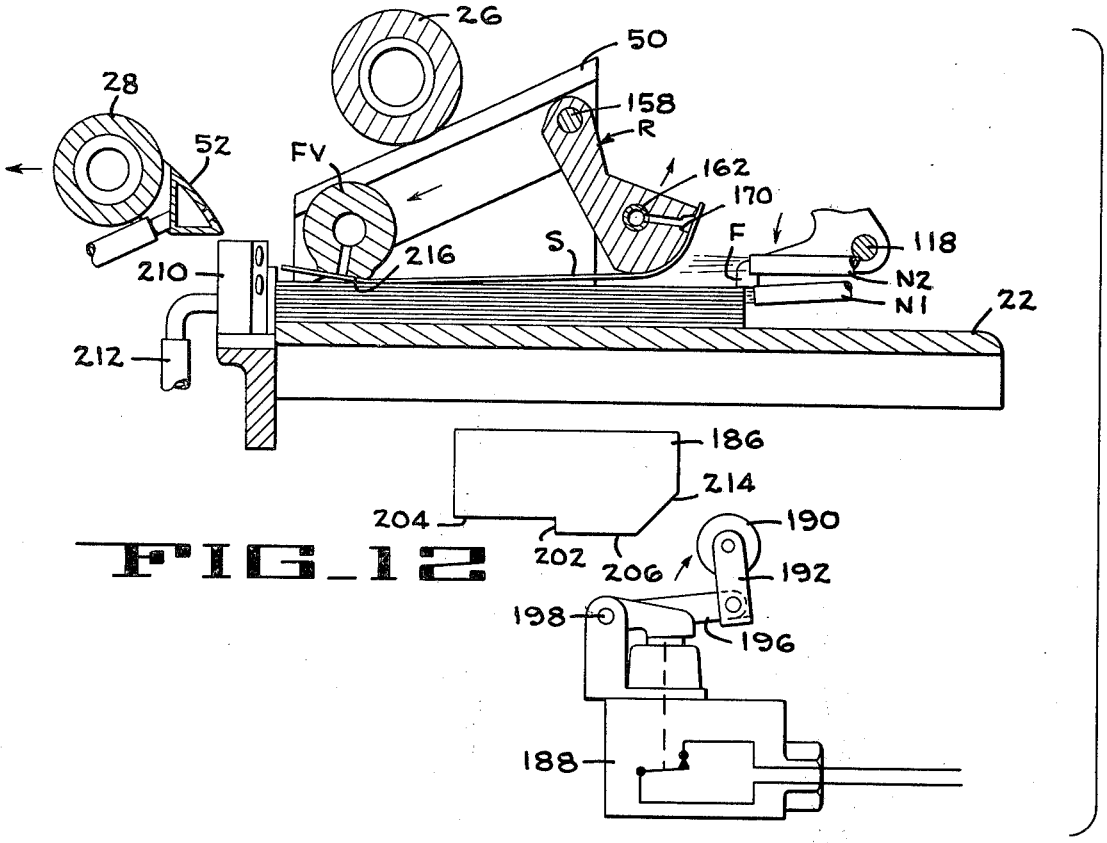

In FIG. 12, the front vacuum head FV has descended into contact with the upper sheet. This contact begins at 130 degrees on the FIG. 15 timing chart and continues long enough for the feed tongue 52 to move in under the sheet. The cam 186 has cleared the switch roller 190 but the contacts of the switch 188 remain closed because although the upper arm 192 has returned to its vertical position relative to the lower arm 196, freeing of the roller 190 allows the lower arm 196 to remain in its upper position. After the carriage has reached the FIG. 12, 130° position, the carriage reverses, the front vacuum head immediately reverses direction and ascends the ramp 50 while pivoting clockwise, to lift the leading edge of the sheet. Thus, the cam 186 also reverses direction, and when a beveled end 214 of the cam depresses the switch roller 190, (the arm 192 cannot collapse to the right) the contacts of the switch 188 open (FIG. 13) and deenergize a valve that directs air to the air cylinder 134 (FIG. 8) so that the rear vacuum shoe R is spring retracted by the coil spring (not shown) inside the cylinder 134. The presser feet F are thus lifted off the second sheet while the carriage C moves the feed roller 28 and the feed tongue 52 toward the sheet which is being lifted by the front vacuum head FV.

Figure 13:
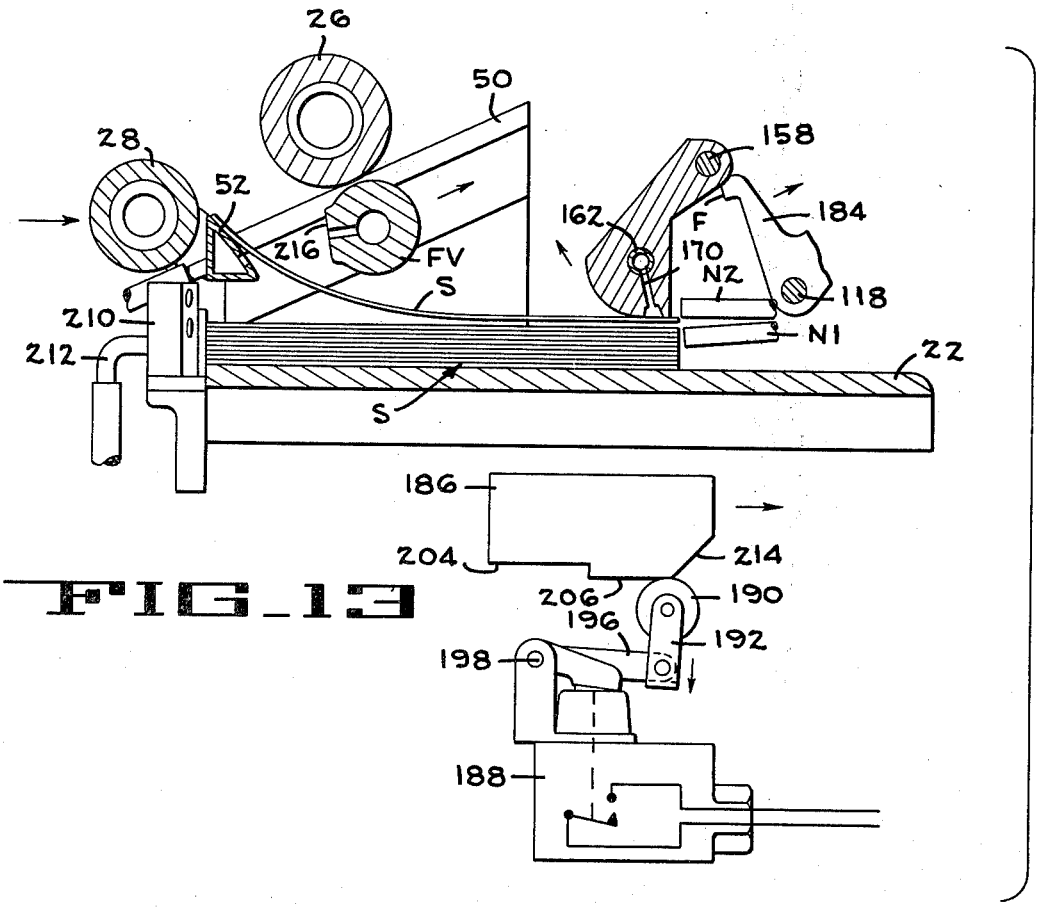

In the 150° position of FIG. 13, the vacuum to the front vacuum head FV have been cut off because the actuator 46 on the carriage bar 48 has opened the valve 40 (FIG. 1) and vented the vacuum line 38 to atmosphere. The front of the top sheet now rests on the feed tongue 52. The rear vacuum shoe R has returned to its initial position where it will dwell for the remainder of the cycle, and the air nozzles N1 and N2 remain inactive. Since the rear show R remains vacuumized, the rear of the top sheet is still suspended by the shoe.

In FIG. 14 (170°), the upper sheet S has been gripped between the feed rolls 26 and 28 and is being slid off the vacuum port 170 in the rear vacuum shoe R. Cam 186 has allowed the switch roller 190 to rise against the holding surface 204 of the cam, but since the switch arm 192 is in its vertical position, the contacts of switch 186 remain open as previously described in connection with FIG. 10. Thus the air cylinder 134 continues to spring retain the rear sheet separator in its retracted position, in readiness for the next cycle.

With reference to FIG. 16, the control elements include power input lines L1 and L2 that continuously energize a vacuum pump and motor unit PM when a main switch SW is closed. The vacuum is preferably controlled by an adjustable regulator R1, and is connected to the rear vacuum shoe R by the conduit 174, as seen in FIG. 4. By controlling this vacuum, a minimum vacuum can be selected that is adequate to lift porous sheets but will not lift or disturb the next underlying sheet, as described. Air under pressure is admitted to the system through an inlet conduit 218 which connects to the solenoid operated valve V1 and through an adjustable pressure regulator R2 to a similar valve V2 for respectively energizing the nozzles N1, N2, and the air cylinder 134. Pressure regulation for the air cylinder 134 is desirable for adjusting the forward acceleration of the rear vacuum shoe R.

The switch 188 that is actuated by the carriage mounted cam 186 is connected to the solenoid of the valve V2 so that when the switch contacts close (as seen in FIGS. 11 and 12), the valve plunger moves to the right and against a spring to align a valve passage between a regulated air line 220 and the air line 150 which leads to the air cylinder 134. As previously described, this causes the rear vacuum shoe R to roll forward and curl the rear edge of the top sheet S. When the actuator 142 of the switch 140 is moved by the trip arm 146, its contacts close and energize the solenoid of valve V1 to move the valve core to the right against a spring. This transmits air to a line 152 which connects to passages (not shown) in the clamp block 78 that lead to the air nozzle tubes N1 and N2.

When the carriage-mounted cam 186 allows the contacts of the switch 188 to open (as seen in FIG. 16), the valve core of the valve V2 is spring returned to the position illustrated and vents the air cylinder line 150 to atmosphere, whereby the internal spring of the air cylinder 134 (not shown) retracts the air cylinder piston and hence the rear vacuum shoe R. The strap 146 now clears the actuator 142 for the switch 140, which opens the switch 140. Line 152 is thus vented to atmosphere through the valve V1, and the control system is in its initial condition ready for another sheet feeding cycle.

Thus it can be seen that the sheet feeder of the present invention provides single sheet feeding by establishing an air cushion beneath substantially the entire under surface of the top sheet S, and that the rear, vacuumized sheet separator shoe R curls up the rear edge of the top sheet only, even when the sheets are porous. By lifting the rear edge of the top sheet above the second sheet, an air blast can be directed between the first and second sheets while hold down feet F clamp the second sheet to the stack during one portion of the air blast. Since the top sheet is held up slightly by the rear sheet separator mechanism SM, the air blast penetrates beneath the separator and forwardly between the sheets. As the front vacuum head FV lifts the front edge of the top sheet, a front air blast cooperates with the rear air blast to provide an air cushion beneath the top sheet and thus free it from the second sheet. By the time the front vacuum head FV has lifted the front edge of the top sheet S to the upper feed rolls 26 and 28, the rear sheet separator shoe R will have retracted sufficiently to cause the hold down feet F to lift from the stack and also turn off the rear air blasts. Even though the rear sheet separator shoe R and the hold down feet F have retracted, their function of freeing the top sheet has been effected.

It should also be noted again that the vacuum for the rear sheet separator shoe R only generates a differential pressure across the top sheet S that is sufficient to lift the top sheet from the stack, and that the vacuum applied to the rear sheet separator shoe R need not be adequate to move the shoe itself.

Another aspect of the invention is that the support for the rear sheet separator shoe R and associated mechanism is arranged to clear the stack elevating table 22 even when the table is at its uppermost position, and that the back stop 24 for the sheets is slidably mounted on the support plate 84 so that when the elevating table 22 nears its uppermost position it elevates the back stop to permit removal of all the sheets from the table.

Although the best mode contemplated for carrying out the present invention has been herein shown and described, it will be apparent that modification and variation may be made without departing from what is regarded to be the subject matter of the invention.

What is claimed is:

1. Sheet feeding apparatus for feeding the top sheet from a stack of sheets supported by the stack elevator of a sheet processing machine, said apparatus comprising a pair of sheet feed rolls, a front vacuum head for lifting the front edge of the top sheet for presentation to the feed rolls, a vacuumized rear sheet separating shoe, means for pivoting the shoe for lifting the rear edge of the top sheet, rear sheet hold down means for engaging the second sheet after the rear edge of the top sheet has been lifted, and front nozzle means for directing an air jet rearwardly beneath the top sheet; the improvement comprising a rear nozzle for directing an air jet forwardly between the top sheet and the second sheet while the rear of the top sheet is lifted by said rear sheet separating shoe and the second sheet is engaged by said hold down means, said front nozzle directing an air jet rearwardly beneath the top sheet when it is lifted by said front vacuum head and cooperating with said rear nozzle for establishing an air cushion beneath the top sheet, and means for disengaging said rear sheet hold down means from the second sheet before said feed rolls grip and slide the top sheet across said stack.

2. The apparatus of claim 1, comprising means for holding the rear sheet separator shoe a short distance above the stack for opening an air passage beneath the top sheet at a zone under the rear sheet separating shoe.

3. The apparatus of claim 2, comprising means to maintain the vacuum on said rear sheet separator shoe when the top sheet is being pulled thereacross by said feed rolls.

4. The apparatus of claim 1, comprising a second rear nozzle for directing a second air jet forwardly against the rear edge of the stack, said second nozzle directing the second air jet below the jet from said first rear nozzle.

5. Rear sheet separator mechanism for lifting the rear portion of the top sheet from a stack of sheets supported by the elevator table of a sheet feeder for a sheet processing machine, said mechanism being of the type comprising support means mounted on the machine, a vacuumized rear sheet separating shoe for lifting a rear portion of the top sheet from the stack, pivot means for mounting said shoe on said support means, means for swinging said shoe about said pivot means, and a hold down foot mounted on said support means for engaging the second sheet after the rear top sheet portion has been lifted; the improvement wherein said shoe has a curved, sheet engaging face that is concentric with the shoe pivot means, a vacuum port opening to said shoe face, said means for swinging said shoe about its pivot means comprising first link means having an outer end connected to the shoe pivot means, second link means pivotally mounted on said support means and being pivotally connected to said shoe at a zone spaced from its pivot means, the inner end of said first link means being pivotally connected to said second link means, and actuator means connected to said link means for causing simultaneous pivoting of the shoe by said second link means and translation of the shoe pivot means by said first link means for rolling said curved face of the shoe along the top sheet.

6. The method of feeding the top sheet from a stack of sheets supported by the stack elevator of a sheet processing wherein the front edge of the top sheet is vacuum lifted and presented to feed rolls, the rear edge of the top sheet is vacuum lifted and the rear edge of the second sheet is held down; the improvement comprising the steps of lifting the rear edge of the top sheet and directing a rear jet of air forwardly between the top sheet and the second sheet while the second sheet is being held down and before lifting the front edge of the top sheet, and removing the hold down on the rear edge of the second sheet before the front edge of the top sheet is picked up by the feed rolls.

7. Rear sheet separator mechanism for lifting the rear portion of the top sheet from a stack of sheets supported by the elevator table of a sheet feeder for a sheet processing machine, said mechanism being of the type comprising support means mounted on the machine, a vacuumized rear sheet separating shoe for lifting a rear portion of the top sheet from the stack, said shoe having a pivot and a curved, sheet engaging face that is concentric with the pivot, means for pivotally mounting said shoe on said support means, means for swinging said shoe about said pivot, and a hold down foot mounted on said support means for engaging the second sheet after the rear top sheet portion has been lifted; the improvement wherein said means for mounting the shoe on said support means comprises vertically spaced link means, one of said link means being pivotally supported by said support means and being pivotally connected to said shoe pivot for translating the shoe, the other of said link means being connected to a portion of the shoe that is radially spaced from the shoe pivot and a linear actuator for operating said link means.

8. Mechanism for separating the top sheet from a stack of sheets supported by the elevator table of a sheet feeder for a sheet processing machine, said mechanism being of the type comprising support means mounted on the machine frame, a rear sheet separating shoe having a vacuumized face for lifting a portion of the top sheet from the stack, means on said support means for mounting said shoe, means for operating said shoe, and a hold down foot mounted on said support means for engaging the second sheet after the top sheet portion has been lifted; the improvement wherein said support means comprises a normally stationary support, link means pivotally mounted on said support, and pivot means for mounting said shoe on said link means, said vacuumized shoe face being curved and generally concentric with the shoe pivot means, said shoe operating means being connected to said link means for rotating said shoe about its pivot means, said link means comprising lever means pivotally mounted on said support means, lower link means pivotally projecting from said lever means with said shoe being pivotally mounted on said lower link means, upper link means extending between said lever means and said shoe for rocking the shoe about its pivot means when said lever means is operated, said shoe operating means comprising an actuator connected to said lever means for simultaneously pivoting the shoe and translating said shoe pivot means to roll the curved face of the shoe along the sheet.

9. The mechanism of claim 8, wherein said lever means comprises a pair of bell crank levers straddling said shoe, one arm of each bell crank lever being connected to said actuator, the other arm of each bell crank lever forming the hold down foot for sheets remaining in the stack.

10. Mechanism for lifting a portion of the top sheet from a stack of sheets supported by the elevator table of a sheet feeder for a sheet processing machine, said mechanism being of the type comprising support means mounted on the machine, a sheet separating shoe having a pivot and a vacuumized face concentric with said pivot for lifting a rear portion of the top sheet from the stack, means for pivotally mounting said shoe on said support means, means for swinging said shoe about said pivot means, and a hold down foot mounted on said support means for engaging the second sheet after the top sheet portion has been lifted; the improvement wherein said means for pivotally mounting said shoe on said support means comprises first link means connected to said shoe pivot, said means for swinging said shoe about its pivot comprising second link means pivotally supported by said support means and pivotally connected to said shoe at a zone radially spaced from the shoe pivot, actuator means connected to said link means, and control means for operating said actuator means in timed relation with said sheet processing machine.

11. Mechanism for lifting a portion of the top sheet from a stack of sheets supported by the elevator table of a sheet feeder for a sheet processing machine, said mechanism being of the type comprising support means mounted on the machine, a sheet separating shoe having a pivot and a vacuumized face concentric with said pivot for lifting a rear portion of the top sheet from the stack, means for pivotally mounting said shoe on said support means, shoe operating means comprising means for swinging said shoe about said pivot in a direction to pick up the rear edge of the top sheet, and a hold down foot mounted on said support means for engaging the second sheet after the top sheet portion has been lifted; the improvement wherein said shoe mounting means comprises link means pivoted to said shoe pivot at an outer end and to said shoe operating means at an inner end, said operating means including an actuator for simultaneously operating said shoe swinging means and for imparting generally horizontal motion to the inner end pivot of said link means for linearly translating said shoe pivot in the plane of the top sheet while the shoe is being swung about its pivot for causing the curved face of said shoe to substantially roll along the top sheet in order to lift and curl an edge portion of the top sheet from the next underlying sheet, said link means and said shoe operating means freely accommodating vertical floating motion of said shoe when it is supported by sheets on said table.

12. Mechanism for separating the top sheet from a stack of sheets supported by the elevator table of a sheet feeder for a sheet processing machine, said mechanism being of the type comprising normally stationary support means mounted on the machine frame, a rear sheet separating shoe having a pivot, a curved face concentric with the pivot extending from a vacuumized face for lifting a portion of the top sheet from the stack, link means pivoted on said support means for mounting said shoe pivot, means for rotating said shoe about its pivot, and a hold down foot mounted on said support means for engaging the second sheet after the top sheet portion has been lifted; the improvement wherein said shoe rotating means also comprises link means pivotally connected to said shoe and pivotally connected to said support means, both of said link means accommodating vertical floating motion of said shoe when it is supported by sheets on said table, stop means for limiting the downward motion of said shoe, and means for operating said shoe rotating means.

* * * * *

UNITED STATES PATENT OFFICE

CERTIFICATE OF CORRECTION

PATENT NO. : 3,980,293

DATED : November 23, 1976

INVENTOR(S) : Donald W. Shelmire

It is certified that error appears in the above-identified patent and that said Letters Patent are hereby corrected as shown below:

| | |
|---|---|
| Column 8, line 68: | after "table" delete --elevation-- and insert --elevating--. |
| Column 10, line 49: | after "about" delete --1/8-- and insert --3/4--. |
| Column 13, line 7: | after "FV" delete --have-- and insert --has--. |
| Column 13, line 14: | after "rear" delete --show-- and insert --shoe--. |

Signed and Sealed this

Eighth Day of March 1977

[SEAL]

*Attest:*

RUTH C. MASON
*Attesting Officer*

C. MARSHALL DANN
*Commissioner of Patents and Trademarks*